5/31/83 XR 4,385,842 SR

United States Patent [19]

Wiesner

[11] 4,385,842

[45] May 31, 1983

[54] ELECTRONIC TIMEPIECE FOR INDICATING DIGITAL SUBDIVISIONS OF TIME IN A SUBSTANTIALLY CONVENTIONAL FORMAT

[75] Inventor: Leo Wiesner, Kew Gardens, N.Y.

[73] Assignee: Timex Corporation, Waterbury, Conn.

[21] Appl. No.: 556,758

[22] Filed: Mar. 10, 1975

[51] Int. Cl.[3] ..... G04B 19/30; G04B 19/34

[52] U.S. Cl. ..... 368/242; 368/240; 340/753; 340/789; 340/804; 340/811; 350/336

[58] Field of Search ..... 58/23 R, 50 R, 127 R, 58/128; 368/242, 240; 340/753, 789, 804, 811; 350/336

[56] References Cited

U.S. PATENT DOCUMENTS

| | | | |
|---|---|---|---|
| 2,745,243 | 5/1956 | Schumacher | 58/50 R |
| 3,258,906 | 7/1966 | Demby | 58/50 R |
| 3,456,152 | 7/1969 | Andersen | 58/50 R X |
| 3,540,209 | 11/1970 | Zatsky et al. | 58/50 R |
| 3,579,976 | 5/1971 | D'Muhala | 58/50 R |
| 3,613,352 | 10/1971 | Giersiepen | 58/50 R |
| 3,844,105 | 10/1974 | Kashio | 58/23 R |
| 3,932,860 | 1/1976 | Cohen | 368/242 X |
| 3,934,241 | 1/1976 | Weigert | 368/242 X |
| 3,969,887 | 7/1976 | Fukumoto | 368/242 |
| 3,987,617 | 10/1976 | Slob | 368/242 |
| 4,079,369 | 3/1978 | Fukumoto | 368/242 |

FOREIGN PATENT DOCUMENTS

| | | |
|---|---|---|
| 2410527 | 9/1974 | Fed. Rep. of Germany . |
| 575146 | 9/1975 | Switzerland . |

*Primary Examiner*—S. J. Witkowski

*Attorney, Agent, or Firm*—William C. Crutcher

[57] ABSTRACT

An electronic watch having a liquid crystal display which presents time information in a substantially conventional presentation of hour, minute and second hands which appear to circulate around the watch face. The display contains sixty equidistant radial hands on an outer circle for the display of both minutes and seconds, and twenty-four equidistant radial hands on an inner circle for the display of hours and half hours. The hands are divided into sets, and each hand in each set is interconnected to form strings of hands with each string having no more than one hand in a set. The circuit interconnections of the hands are provided on a surface of a substrate of the display without crossover of the connecting leads. A parallel substrate has formed thereon transparent electrodes each associated with and overshadowing a set of hands. Thus, in accordance with the invention a matrix arrangement and electronic circuitry are provided for actuating the hands to display time information to the nearest hour, minute and second.

8 Claims, 10 Drawing Figures

ELECTRONIC TIMEPIECE FOR INDICATING DIGITAL SUBDIVISIONS OF TIME IN A SUBSTANTIALLY CONVENTIONAL FORMAT

FIELD OF THE INVENTION

This invention relates to horologic displays and more particularly to a configuration of an electronic watch having a liquid crystal display in which the hours, minutes and seconds time information is displayed substantially as conventional watch hands which appear to circulate around the watch face.

BACKGROUND OF THE INVENTION

In recent years, fully electric or electronic watches have been suggested in which the time display, in place of traditional rotating hands, would be a series of lamps or lamp-like devices such as is shown in U.S. Pat. No. 3,754,392 issued Aug. 28, 1973 to R. Gary Daniels. However, the high power consumption and cost of such devices has made such suggestions impractical.

More recent designs of fully electronic watches have resulted in the provision of more conventional circulating hand configurations for the display of time information such as is shown in U.S. Pat. No. 3,823,549 issued July 16, 1974 to Bernard Feldman and U.S. Pat. No. 3,540,209 issued Nov. 17, 1970 to Norman C. Zatsky and Eugene R. Keeler. However, in attempting to provide the equivalent of circulating watch hands, these designs required a large number of electrical connections to the display, for example, as shown in U.S. Pat. No. 3,823,549 a large number of electrical connections are required to display only twelve five minute interval hands necessitating the use of non-conventional minute indicating dots.

OBJECTIVES OF THE INVENTION

It is an object of the present invention to provide a fully electronic watch for indicating time by a conventional presentation of time.

It is a further object of this invention to provide in a fully electronic watch a conventional display of time to the nearest hour, minute and second using fewer electrical connections to the display than was heretofore possible.

It is still a further object of this invention to provide a liquid crystal display having electrically conductive, selectively energizable hands on a surface of a substrate interconnected without crossover of the connecting leads.

It is a still further object of this invention to provide a matrix arrangement on a liquid crystal display and logic for applying potentials to the matrix arrangement for selectively actuating to visibility conventionally appearing watch hands in accordance with a binary signal output representing time.

It is a still further object of this invention to provide a fully electronic watch having a display and associated logic so that greater detail of time information can be displayed than was heretofore possible thereby eliminating any possible ambiguity of the time being displayed.

SUMMARY OF THE INVENTION

An electric timepiece is provided having a liquid crystal time indicating display. The display comprises two substrates with electrooptic means confined in between. A first of the substrates has a plurality of selectively energizable fixed position electrically conductive elements formed thereon. The elements are divided into a plurality of sets with each element in a set connected to an element in another set to form strings of connected elements. The other substrate has a plurality of electrodes formed thereon each associated with a set of elements. The display is actuated by the application of a potential coincidentally across an element and a electrode associated with the element by applying the potential to the proper string and to the proper electrode.

Electronic circuitry, including an oscillator, logic, frequency division functions and a decoder/matrix provides respective signals to selectively actuate an element or elements to visually represent time information.

The accompanying drawings diagrammatically illustrate an embodiment of the present invention by way of example. Like numerals refer to like parts throughout.

DETAILED DESCRIPTION OF THE INVENTION

Figure 1:
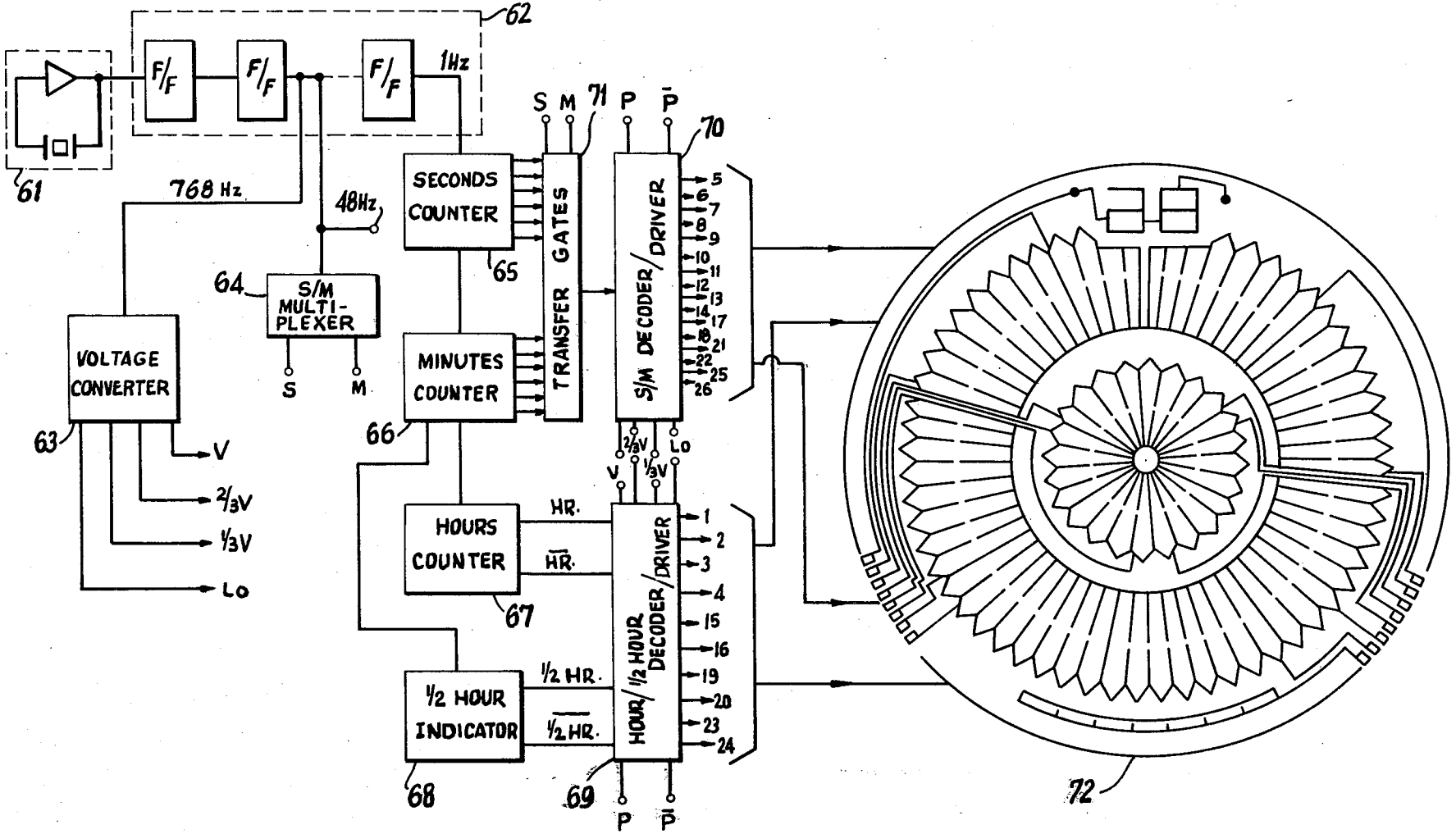
FIG. 1 is a block diagram showing the logic and driving circuits for a fully electronic watch having a conventionally appearing display.

Referring now to FIG. 1, a horologic display having radial hands formed on an outer and inner circle is shown.

The display is actuated by a driving circuit which generally consists of a frequency standard 61, frequency dividing unit 62, counters 65, 66, 67 and decoder/driver circuitry 69, 70. The frequency dividing unit 62 provides a 1 HZ, 48 HZ and 768 HZ output signal. The 1 HZ signal is coupled to the "seconds" counter 65 which counts the number of 1 HZ pulses received from 0 to 59 and provides a binary count of the pulses to transfer gates 71 and a one minute pulse, i.e. sixty second count, to the "minutes" counter 66. The minutes counter 66 counts the number of one minute pulses received from 0 to 59, provides a binary count of the pulses received to transfer gates 71, a half hour count to the "half hour indicator" 68 and an hour pulse, i.e. sixty minute count, to the "hours" counter 67. The 48 HZ signal is coupled to a second/minute multiplexer 64 which provides a second/minute pulse to a series of transfer gates 71 causing the seconds and minutes count to be provided to the seconds and minutes decoder/driver 70 in a time-shared manner. The 768 HZ signal is coupled to the voltage converter 63 which in turn supplies the actuating voltage potentials applied to the display. The half hour indicator 68 and hours counter 67 provide the half hour and hours count respectively, to decoder/driver 69. The decoder/drivers 69, 70 decodes the binary coded time information and selectively applied the actuating voltage potentials, i.e. v, $\frac{2}{3}$ v, $\frac{1}{3}$ v, Lo, to the display causing the decoded time information to be displayed in terms of minutes, seconds and to the nearest half hour.

Figure 2A:
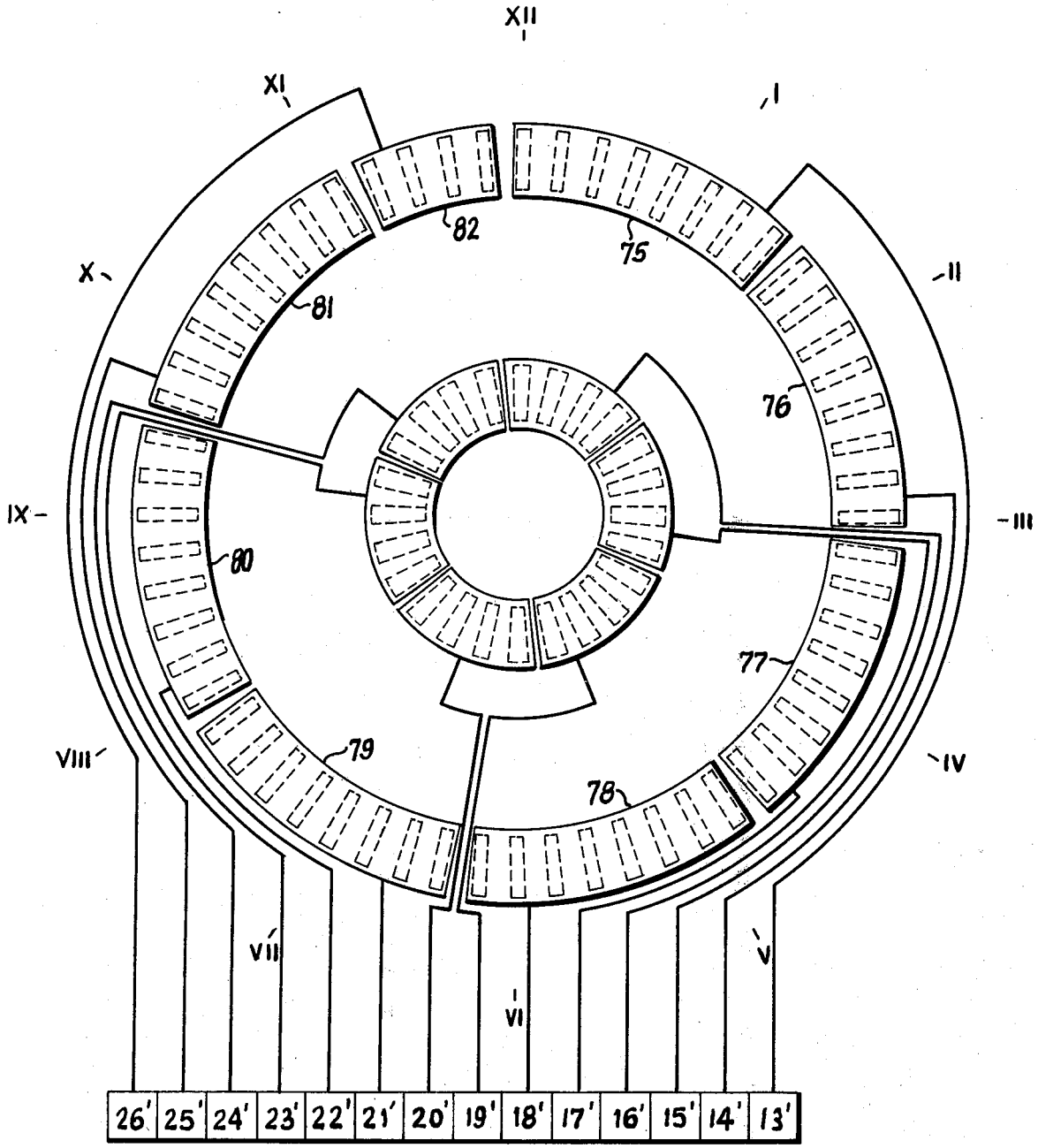
FIGS. 2A and 2B show diagrammatically the pattern of electrical conductors formed on the upper and lower plates of a liquid crystal display in accordance with the invention.
Figure 2B:
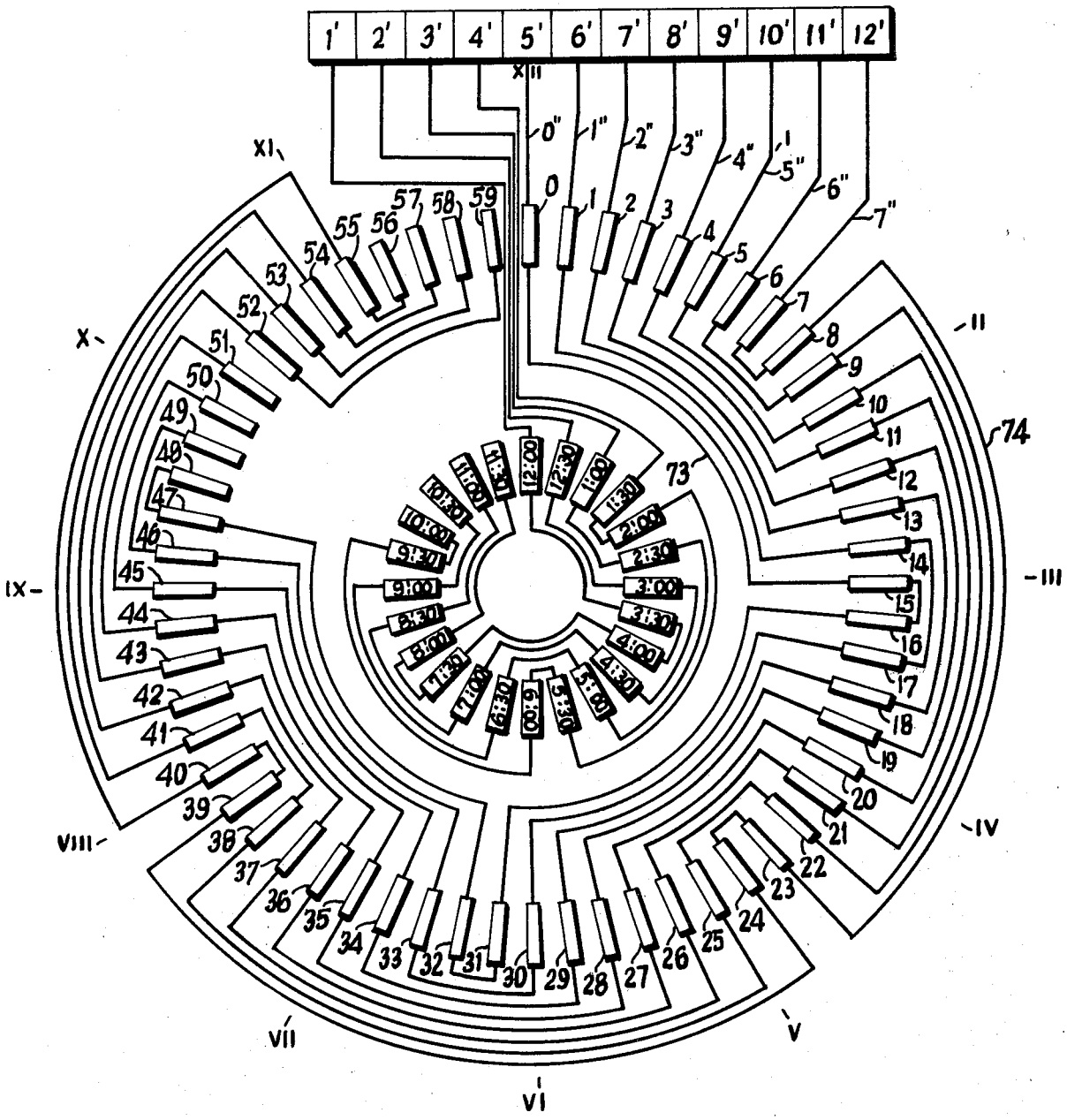

Reference will now be made to FIGS. 2A and 2B in which the display 72 is shown in more detail.

In the preferred embodiment of the invention, the two substrates of a liquid crystal display are coated with a pattern of conductors. The pattern on the lower substrate comprises sixty equidistant radial hands formed on an outer circle for indicating minutes and seconds, and twenty-four equidistant radial hands formed on an inner circle for indicating hours and half hours. The hands, for example, are transparent conductors which are aligned with transparent conductors on the upper substrate and serve to apply a potential across a suitable liquid crystal material confined between the substrates, so as to give a visual indication in a manner well known in the art.

The minute/second hands 0 through 59 are in effect divided into eight sets or groups. The first seven sets, in the clockwise direction from the 12:00 position, each contain eight hands 0 through 7, 8 through 15, etc. and the last set contains four hands 56 through 59. An electrical connection 5' through 12' is provided to each hand 0 through 7 in the first set. Each hand in each set is connected to one hand in an adjoining set to form eight separate, and hereinafter referred to as, strings 0'' through 7'' of hands. Each string has no more than one interconnected hand in a set. For example, string 0'' has one hand 0 in the first set 0 through 7, one hand 15 in the second set 8 through 15 and only one hand 16, 31, 32, 47, 48 in each of the other sets 16-23, 24-31, 32-39, 40-47, 48-55, 56-59, respectively. The interconnections of the hands between sets to form the strings 0'' through 7'' of (series) connected hands is effected on one surface of the lower substrate without crossover or overlaying the conductors by forming a pattern 73, 74 of conductors in which the hands in adjoining sets are interconnected in reverse consecutive order. For example, hand 0 occupies the first position, sequentially in the clockwise direction starting from the 12:00 position, in the first set 0 through 7 and is connected to hand 15 which occupies the last position in the second set 8 through 15. The patterns 73, 74 of conductors are, also, arranged or formed to connect the hands of adjoining sets in a, and hereinafter referred to as, alternating manner. For example, the pattern 73 of conductors which connect the hands of the first and second set are formed at the inner end of the hands which is nearest the center of the substrate and the pattern 74 of conductors which connect the hands of the second and third set are formed at the outer end of the hands which is farthest from the center of the substrate. Thus, the patterns 73, 74 of conductors are formed in alternating manner from the inner to outer end of the hands sequentially around the substrate.

The hour and half hour hands are interconnected in a pattern similar to the arrangement described above for the minute/second hands.

The upper substrate has formed thereon eight transparent electrodes 75 through 82 each associated with and overshadowing one set of minute/second hands 0 through 7, 8 through 16, etc., respectively.

Thus an eight-by-eight matrix, i.e., 8 strings of minute/second hands by 8 associated electrodes, is provided for actuating the minute/second hands, in a time-shared arrangement, and a four-by-six matrix, i.e., 4 strings of hour/half hour hands by 6 associated electrodes, is provided for actuating the hour/half hour hands by applying an actuating potential coincidentally to the transparent electrode and to the string which contains the hand representative of the decoded binary output representing time information.

Figure 3:
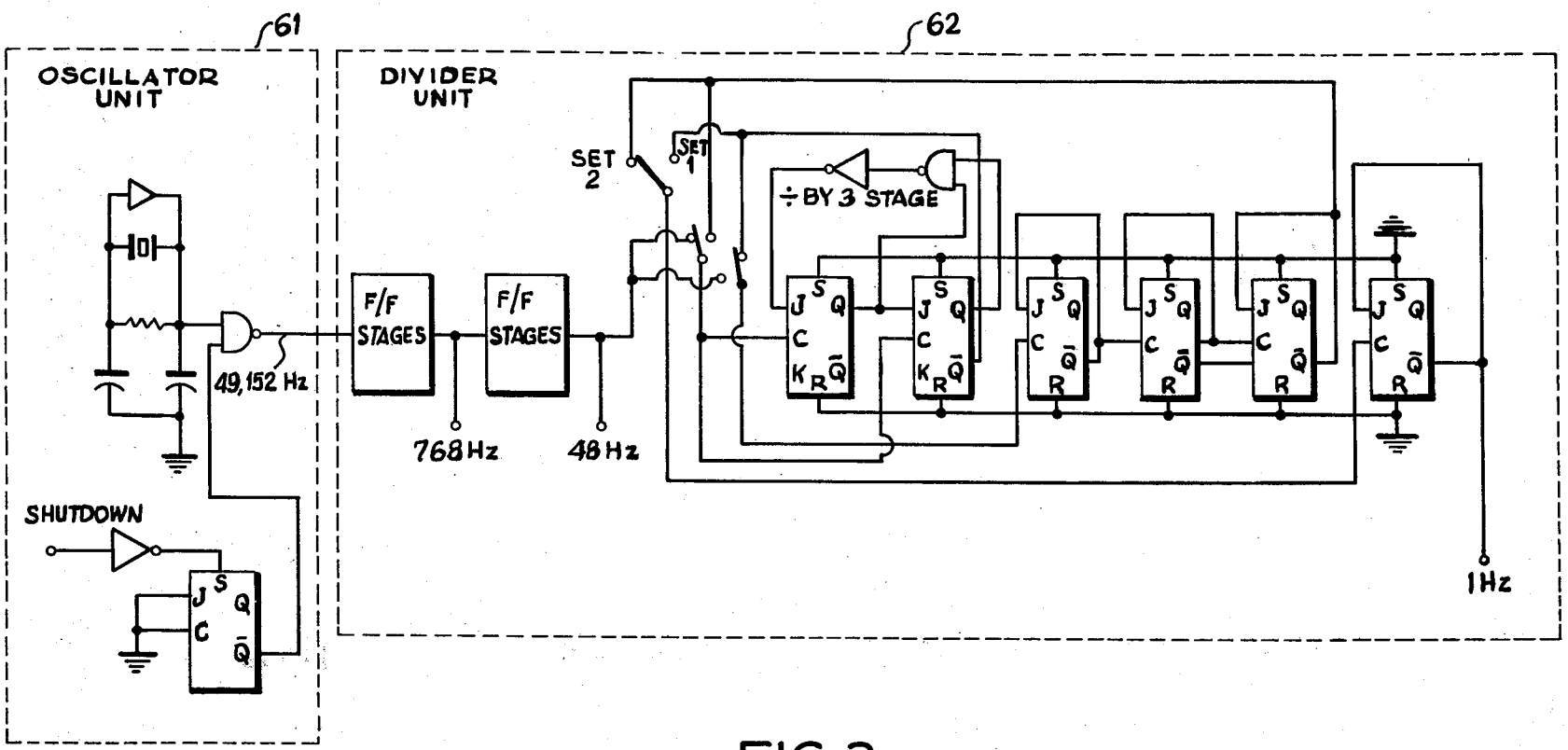
FIG. 3 is a schematic diagram of the oscillator and divider circuit.

Reference will now be made to FIG. 3 in which the oscillator 61 and divider 62 units are schematically shown. The oscillator 61 basically consists of a crystal oscillator having a frequency of 49, 152 HZ. The output of the oscillator is coupled to the input of the divider unit 62. Divider unit 62 comprises known logic circuitry of a series of "flip-flops" for dividing down the frequency standard to obtain the 768 HZ, 48 HZ, and 1 HZ signals. Since circuitry for performing this function is well known to those skilled in the art, further details thereof have been omitted to avoid prolixity.

Figure 4A:
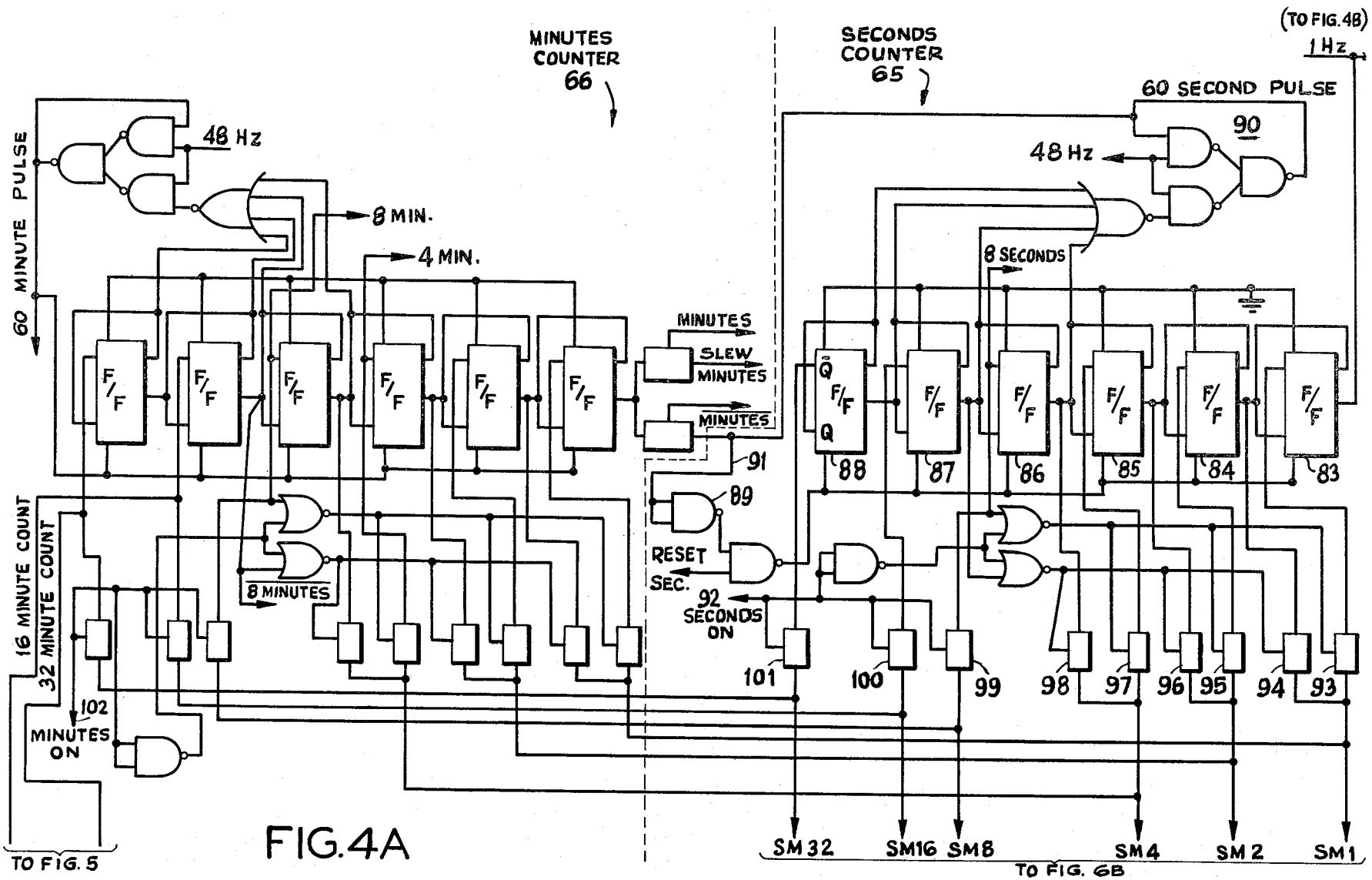
FIGS. 4A and 4B are schematic diagrams of the seconds and minutes counters.
Figure 4B:
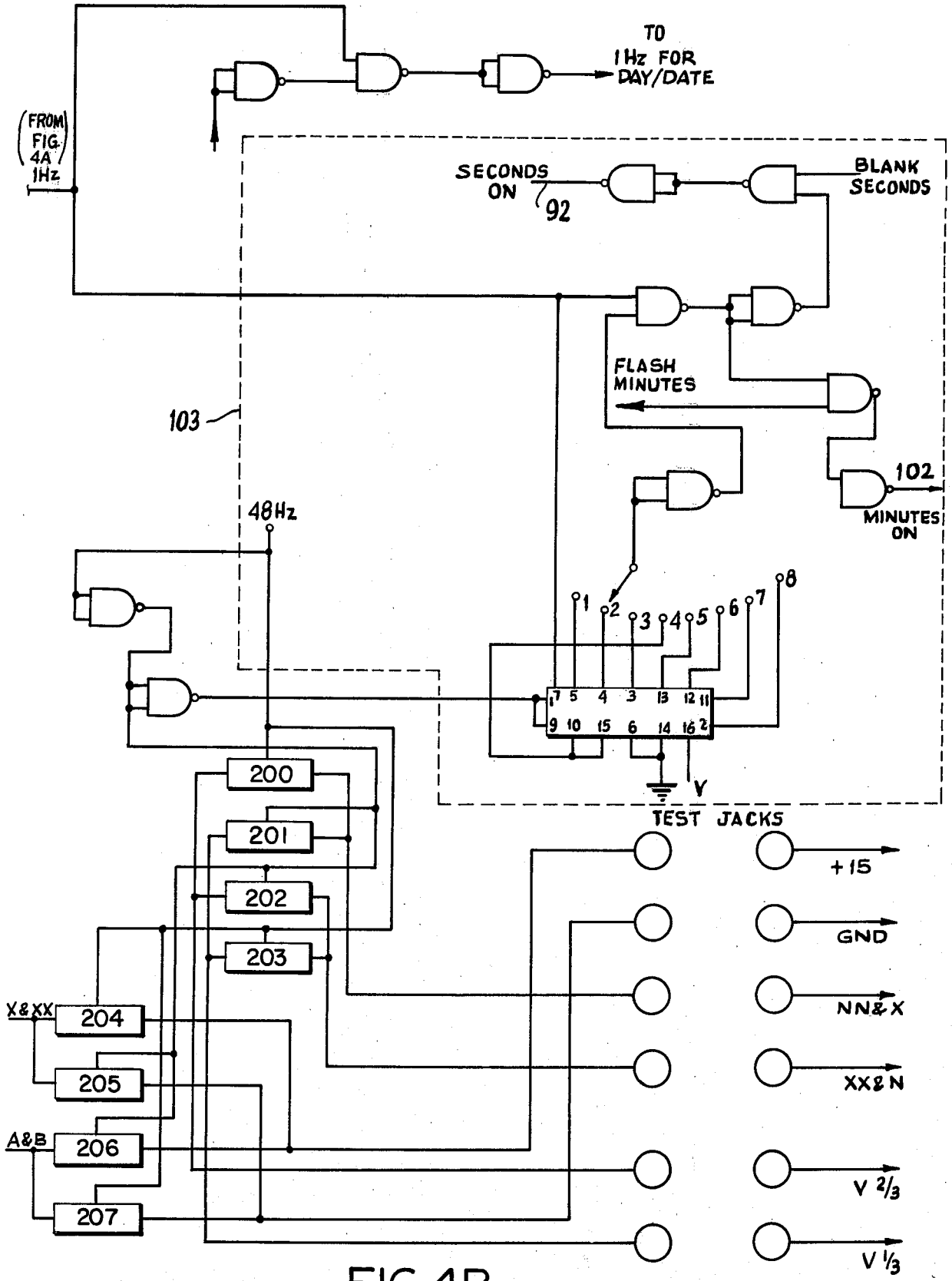

Referring now to FIGS. 4A and 4B in which schematic diagrams are shown of the seconds 65 and minutes 66 counter. Counters suited for performing this function are well known to those skilled in the art such as is described in U.S. Pat. No. 3,754,392 and, therefore, are not discussed herein in detail. Briefly, however, the counters may use "D", "toggle" or "J-K" type flip-flops. For example, the seconds counter 65 consists of six "D" flip-flops 83-88. The input to the seconds counter 65 is the 1 HZ signal coupled to the clock of "D" flip-flop 83. It is the purpose of this counter to store the number of 1 HZ pulses received and provide a binary count of this count, when interrogated, to outputs SM 1, SM 2, SM 4, SM 8, SM 16 and SM 32. It should be noted throughout the discussion of the operation of the second and minute counters, that the "0" pulse represents the 12:00 position and the "59" pulse represents the 59th hand position on the watch face and that the "60th" pulse resets the counters to zero. In order to reset the counters to zero at the incoming "60th" pulse, NAND gate logic 89 is used. The system for limiting the count centers around the use of the 60 second pulse count gate 90. The input to the 60 second pulse count gate 90 is obtained from flip-flops 85, 86, 87 and 88. The binary count of these flip-flops equals a count of 60. Thus, the "60th" pulse to seconds counter 65 enables the 60 second pulse count gate 90 for providing a reset to the seconds counter via NAND gate logic 89 and a minute pulse, i.e. 60 seconds pulse, to the input 91 of the minutes counter 66. The seconds count output is interrogated, i.e., enabled, in a time-share manner by a "second on" pulse 92 which enables transfer gates 93–101 to couple the stored seconds count to outputs SM 1–SM 32.

The minutes counter 66 functions substantially in the same manner, by an interrogation "minutes on" pulse 102 to couple the stored minutes count to the counter outputs SM 1–SM 32, as does the seconds counter 65.

The seconds and minutes counters 65, 66 are interrogated in a time-share manner by a "seconds on" pulse 92 and a "minutes on" pulse 102 provided by the time-share unit 103. The time sharing between the minutes and seconds display provides for activation of the seconds display for the first 1, 2, 3 or 4 cycles of display excitation frequency "N" occurring in each second, while the minutes display is activated for the remaining (N-1), (N-2), (N-3) or (N-4) cycles, respectively. Thus if the display, such as a liquid crystal display, is excited by a 48 HZ square wave then the "seconds on" pulse 92 would comprise the first 4 cycles of the 48 HZ excitation signal while the "minutes on" pulse 102 would comprise N-4 cycles or 48-4 which equals 44 cycles of the excitation signal. In this manner, the hands 0–59 are caused to be sequentially actuated to display a blinking second hand which appears to circulate around the watch face while a minute hand appears actuated for substantially a full minute, i.e. N-4 excitation cycles.

Figure 6A:
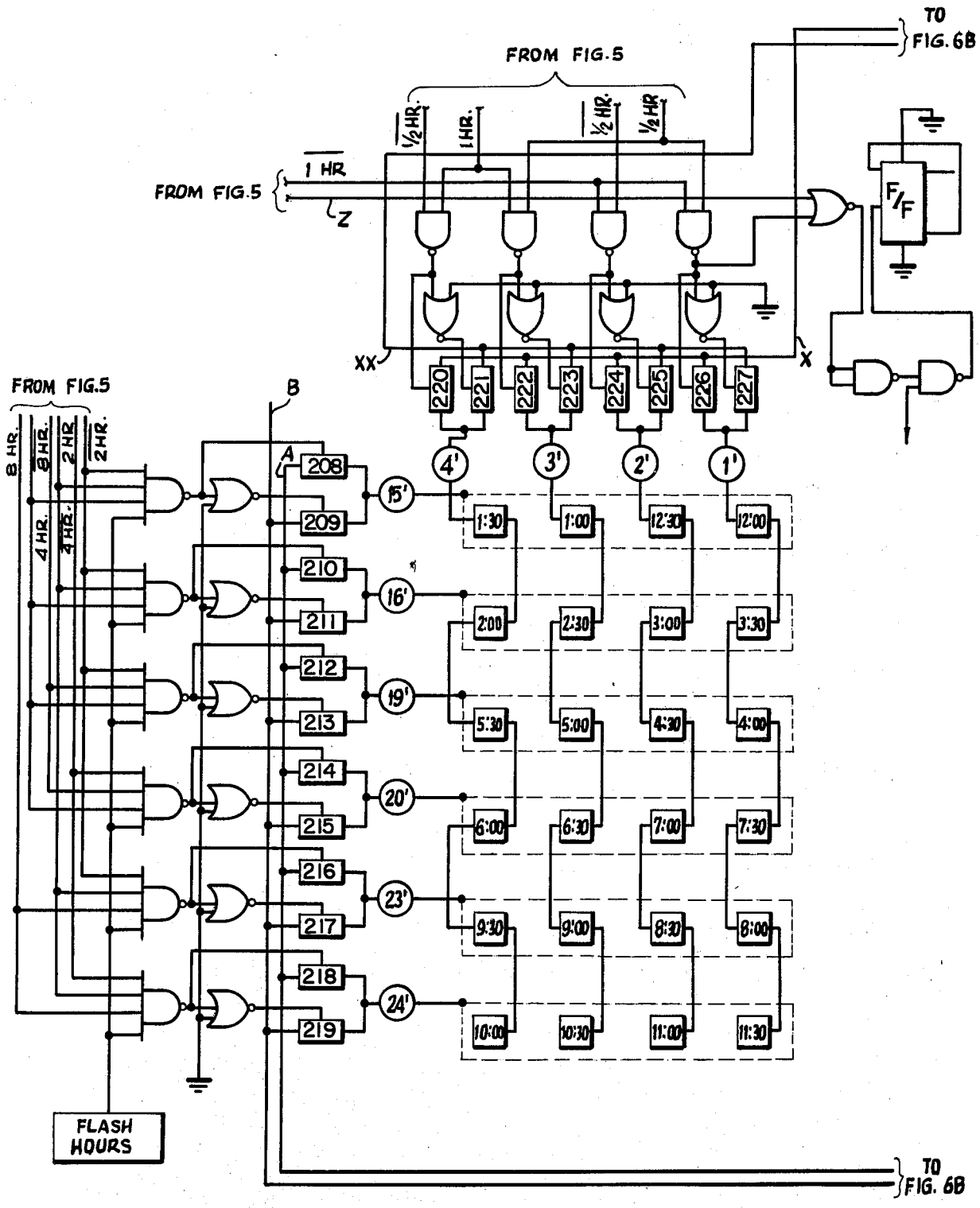
FIGS. 6A and 6B are schematic diagrams of the decoder/driver logic and matrix arrangement of the display.
Figure 6B:
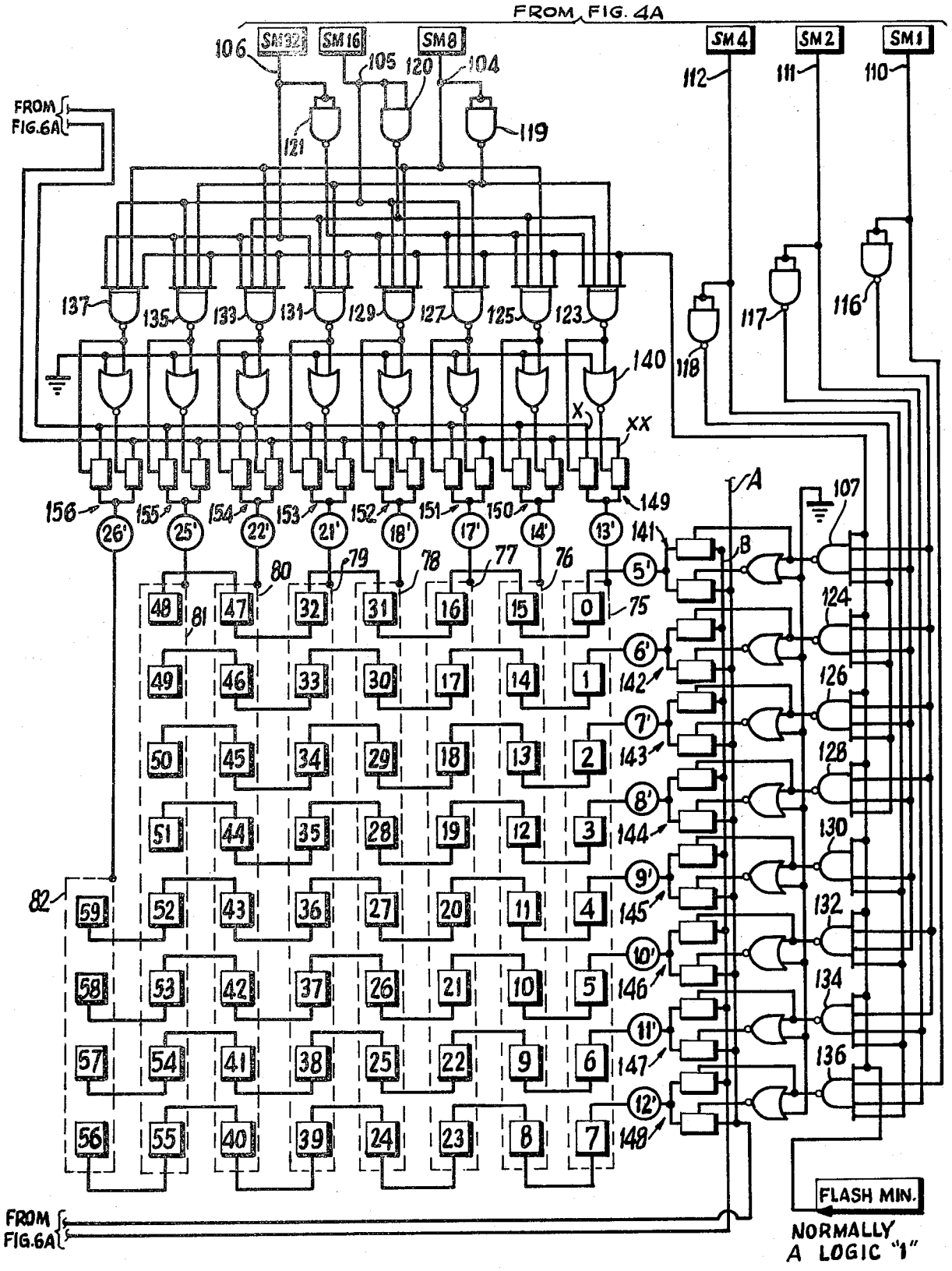

It is to be recognized that the voltages applied to the display, i.e., V, $\frac{2}{3}$ V, $\frac{1}{3}$ V, and Lo, are coupled, via transfer gates 204–207, to the electrical conductors A, B, X and XX shown in FIGS. 6A and 6B. The voltages to be applied, via the transfer gates 204–207, to these electrical conductors A, B, X and XX can be selected by means of the Test Jacks.

Figure 5:
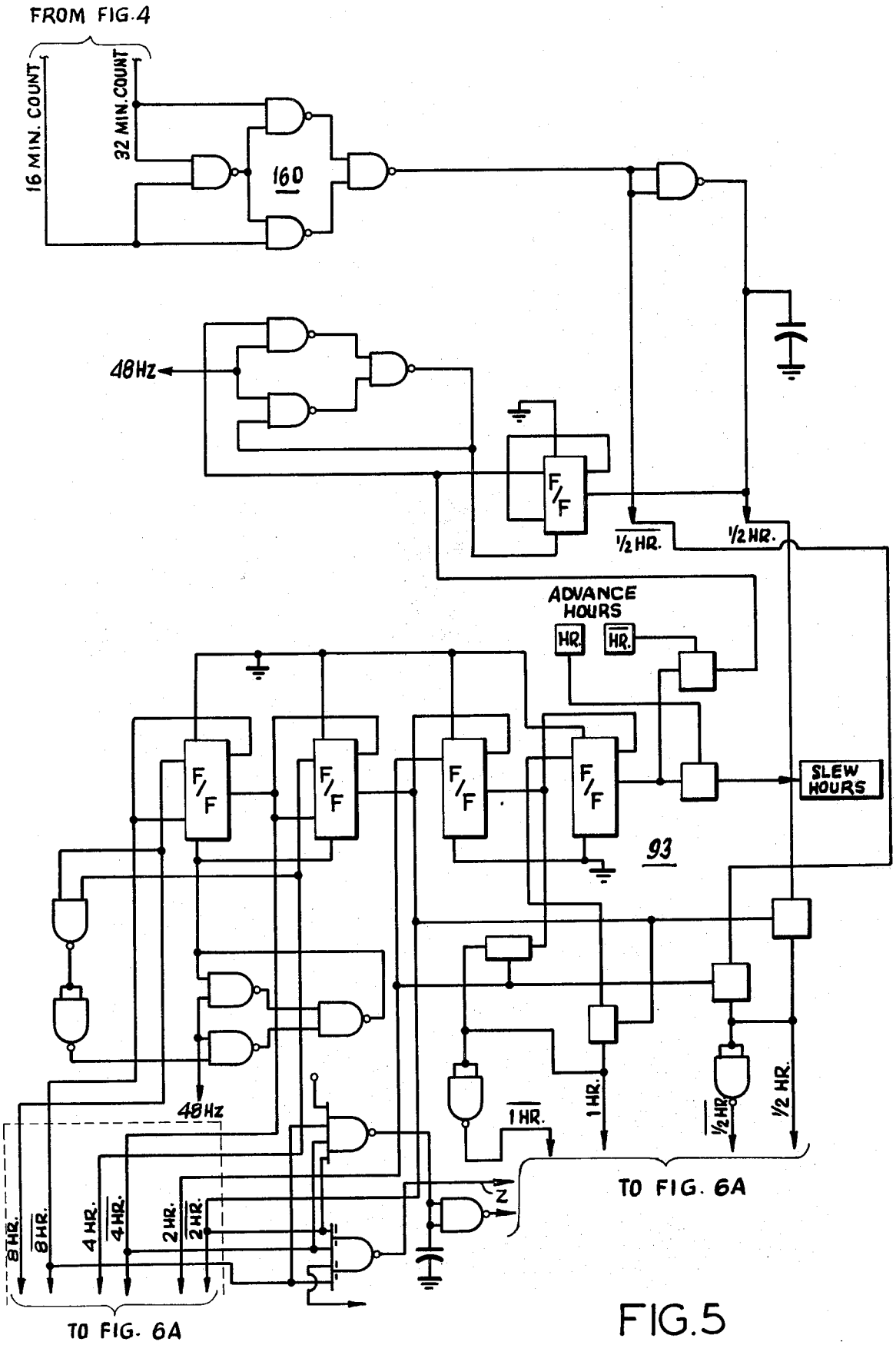
FIG. 5 is a schematic diagram of the hours counter and logic to generate the half hour enable signals.

Reference will now be made to FIG. 5 in which the hours counter 67 and half hour indicator 68 are shown. A 16th and 32nd minute count signal are coupled to the input of exclusive "OR" circuit 160 from the minutes counter.

The "OR" circuit 160 is enabled by one or the other of the inputs, i.e. the 16th or 32nd minute count signal, and is disabled when neither or both of the inputs are present. Thus, the "OR" circuit 160 functions as an "exclusive OR" gate to provide a half hour enable pulse from a count of 16 minutes to a count of 48 minutes. The representative signals provided thereby are the $\frac{1}{2}$ HR and $\overline{\frac{1}{2}\text{ HR}}$ pulse. These pulses are decoded by the decoder such that the half hour hands are actuated, for example, from 15 minutes after the full hour to 13 minutes before the next full hour. For example, the half hour hand corresponding to 2:30 is actuated from the end of 2:15 to the end of 2:47 and the full hour hand corresponding to 3:00 is actuated from the end of 2:47 to the end of 3:15.

Since counters suited for performing the function of storing the count of hour pulses are well known by those skilled in the art, a discussion of their operation is not repeated herein to avoid prolixity.

Reference will now be made to FIGS. 6A and 6B in which is shown a schematic diagram of the decoder/-driver units 69, 70 and the matrix arrangement of the liquid crystal display elements 0–59. The 1, 2 and 4 minute/second count outputs SM 1, SM 2, SM 4 of the counters 66, 65 are coupled to the decoder logic inputs 110, 111 and 112, respectively.

The 1, 2 and 4 minute/second count outputs from the counters are decoded and actuating potentials are applied, via transfer gates 141–148, to first electrical connections 5' through 12' on a lower substrate of a liquid crystal display. The first electrical connections are coupled to display hands 0–7 and are each associated with a string as hereinbefore described with reference to FIG. 2. The 8, 16 and 32 minute/second outputs SM 8, SM 16, SM 32 of counters 66, 65 are coupled to decoder logic inputs 104, 105 and 106, respectively. The 8, 16 and 32 minute/second count outputs from the counters are decoded and coincident actuating voltage potentials are applied, via transfer gates 149–156, to second electrical connections 13'–26' on an upper substrate of a liquid crystal display. The second electrical connections are each coupled to a transparent electrode formed on the upper substrate, i.e. 75, 76, etc. shown in dotted lines overshadowing a respective set of elements.

The decoder and driver logic will now be discussed to provide an illustrative example of the decoding circuitry. For example, if "0" seconds is stored in the seconds counter 65, all the counter outputs S/M 1 through S/M 32 would be a logic "0" during the seconds interrogation period, i.e. the first four cycles of the liquid crystal excitation square wave signal. The logic "0" is coupled to the decoder logic inputs 110, 111, 112, 104, 105, 106 and are inverted to a logic "1" by inverters 116 through 121. The logic "1's" inverted by the inverters 116, 117, 118 are applied to the inputs of gate 107. The fourth input "Flash Min" of this gate 107, and gates 124 through 136 and 123 through 137, is normally at a logic "1" condition. The output of NAND gate 107 is a logic "0" which is inverted to a logic "1" by NOR gate 108 for enabling transfer gate 141. With transfer gate 141 enabled, the voltage potential on conductor A is applied to first electrical connection 5' and thence to the first string of hands comprising hands 0, 15, 16, 31, 32, 47 and 48 shown in FIGS. 2 and 6. The logic "1" inverted by inverters 119, 120 and 121 are applied to the three inputs of gate 123. The output of NAND gate 123 is a logic "0" which is inverted to a logic "1" by NOR gate 140 for enabling transfer gate 149. With transfer gate 149 enabled, the voltage potential on conductor "XX" is applied to second electrical connection 13' and thence to the transparent electrode 75 associated with the first set of hands 0–7. The transparent electrode 74 associated with the first set 0–7 is more clearly shown in FIG. 2. By having the potentials on conductors "XX" and "A" coupled, for example, to "V" and "Lo" of the voltage converter 63 an actuating potential is applied across hand 0 causing it to become visible thereby indicating zero seconds. By having the potentials on conductors "X" and "A" coupled, for example, to "$\frac{1}{3}$ V" and "$\frac{2}{3}$ V" of the voltage converter 63 the segments not interrogated are prevented from being activated as hereinafter described. The actuating potentials used in the preferred embodiment and method of applying are fully described in assignee's copending patent application Ser. No. 463,927 filed Apr. 25, 1974 in the name of Sam G. Cohen.

Briefly, the driver display circuit of the invention described in co-pending patent application Ser. No. 463,927 provides a means of preventing the undesired segments from reaching a threshold activation voltage. A liquid crystal is selected with a fairly sharp threshold voltage $V_t$ between no reaction and activation. By applying twice the threshold voltage to a segment that is desired to be activated and applying a level of one third of this double threshold voltage to the unwanted segments in a prescribed manner the display operates as desired. For example, in particular, if a positive voltage (double threshold) 2 $V_t$ is applied to selected conductive segments on the bottom glass plate, and ground (zero voltage) is applied to a selected large segment of the upper plate, the lower segment located under the selected upper segment will be activated. To prevent any other segments from being partially activated, all unused upper plate segments are returned to a voltage level $V_2$ of two-thirds of the supply voltage and all unused bottom plate strings are returned to a voltage level $V_1$ of one-third of the supply voltage. For the case where AC excitation is required, when the excitation to the desired segment is reversed, then the $V_1$ and $V_2$ voltages on the bottom and top plates applied to unused segments are also reversed.

To avoid prolixity, tables 1 and 2 are provided to concisely show the actuating sequence of the hands corresponding to the stored count by the application of an actuating potential on the corresponding first and second electrical connections. As mentioned hereinbefore, each of the aforementioned counters 65, 66, 67 have an output in binary form. The output for the seconds and minutes counters 65, 66 is in the form of six bits designated SM 1 through SM 6. The output of the hours counter 67 is in the form of four bits. For reference the corresponding decimal number is provided which corresponds to both the number of pulses received by the respective counters and the numbered liquid crystal hand actuated. For simplicity, only the actuating potentials to the first and second electrical connection for actuating the interrogated time indicating element are shown for example as V = +5 volts and Lo = ground potential.

TABLE 1

| No. | SM6 | SM5 | SM4 | SM3 | SM2 | SM1 | V. | Lo. |
|---|---|---|---|---|---|---|---|---|
| 0 | 0 | 0 | 0 | 0 | 0 | 0 | 5′ | 13′ |
| 1 | 0 | 0 | 0 | 0 | 0 | 1 | 6′ | 13′ |
| 2 | 0 | 0 | 0 | 0 | 1 | 0 | 7′ | 13′ |
| 3 | 0 | 0 | 0 | 0 | 1 | 1 | 8′ | 13′ |
| 4 | 0 | 0 | 0 | 1 | 0 | 0 | 9′ | 13′ |
| 5 | 0 | 0 | 0 | 1 | 0 | 1 | 10′ | 13′ |
| 6 | 0 | 0 | 0 | 1 | 1 | 0 | 11′ | 13′ |
| 7 | 0 | 0 | 0 | 1 | 1 | 1 | 12′ | 13′ |
| 8 | 0 | 0 | 1 | 0 | 0 | 0 | 12′ | 14′ |
| 9 | 0 | 0 | 1 | 0 | 0 | 1 | 11′ | 14′ |
| 10 | 0 | 0 | 1 | 0 | 1 | 0 | 10′ | 14′ |
| 11 | 0 | 0 | 1 | 0 | 1 | 1 | 9′ | 14′ |
| 12 | 0 | 0 | 1 | 1 | 0 | 0 | 8′ | 14′ |
| 13 | 0 | 0 | 1 | 1 | 0 | 1 | 7′ | 14′ |
| 14 | 0 | 0 | 1 | 1 | 1 | 0 | 6′ | 14′ |
| 15 | 0 | 0 | 1 | 1 | 1 | 1 | 5′ | 14′ |
| 16 | 0 | 1 | 0 | 0 | 0 | 0 | 5′ | 17′ |
| 17 | 0 | 1 | 0 | 0 | 0 | 1 | 6′ | 17′ |
| 18 | 0 | 1 | 0 | 0 | 1 | 0 | 7′ | 17′ |
| 19 | 0 | 1 | 0 | 0 | 1 | 1 | 8′ | 17′ |
| 20 | 0 | 1 | 0 | 1 | 0 | 0 | 9′ | 17′ |
| 21 | 0 | 1 | 0 | 1 | 0 | 1 | 10′ | 17′ |
| 22 | 0 | 1 | 0 | 1 | 1 | 0 | 11′ | 17′ |
| 23 | 0 | 1 | 0 | 1 | 1 | 1 | 12′ | 17′ |
| 24 | 0 | 1 | 1 | 0 | 0 | 0 | 12′ | 18′ |
| 25 | 0 | 1 | 1 | 0 | 0 | 1 | 11′ | 18′ |
| 26 | 0 | 1 | 1 | 0 | 1 | 0 | 10′ | 18′ |
| 27 | 0 | 1 | 1 | 0 | 1 | 1 | 9′ | 18′ |
| 28 | 0 | 1 | 1 | 1 | 0 | 0 | 8′ | 18′ |
| 29 | 0 | 1 | 1 | 1 | 0 | 1 | 7′ | 18′ |
| 30 | 0 | 1 | 1 | 1 | 1 | 0 | 6′ | 18′ |
| 31 | 0 | 1 | 1 | 1 | 1 | 1 | 5′ | 18′ |
| 32 | 1 | 0 | 0 | 0 | 0 | 0 | 5′ | 21′ |
| 33 | 1 | 0 | 0 | 0 | 0 | 1 | 6′ | 21′ |
| 34 | 1 | 0 | 0 | 0 | 1 | 0 | 7′ | 21′ |
| 35 | 1 | 0 | 0 | 0 | 1 | 1 | 8′ | 21′ |
| 36 | 1 | 0 | 0 | 1 | 0 | 0 | 9′ | 21′ |
| 37 | 1 | 0 | 0 | 1 | 0 | 1 | 10′ | 21′ |
| 38 | 1 | 0 | 0 | 1 | 1 | 0 | 11′ | 21′ |
| 39 | 1 | 0 | 0 | 1 | 1 | 1 | 12′ | 21′ |
| 40 | 1 | 0 | 1 | 0 | 0 | 0 | 12′ | 22′ |
| 41 | 1 | 0 | 1 | 0 | 0 | 1 | 11′ | 22′ |
| 42 | 1 | 0 | 1 | 0 | 1 | 0 | 10′ | 22′ |
| 43 | 1 | 0 | 1 | 0 | 1 | 1 | 9′ | 22′ |
| 44 | 1 | 0 | 1 | 1 | 0 | 0 | 8′ | 22′ |
| 45 | 1 | 0 | 1 | 1 | 0 | 1 | 7′ | 22′ |
| 46 | 1 | 0 | 1 | 1 | 1 | 0 | 6′ | 22′ |
| 47 | 1 | 0 | 1 | 1 | 1 | 1 | 5′ | 22′ |
| 48 | 1 | 1 | 0 | 0 | 0 | 0 | 5′ | 25′ |
| 49 | 1 | 1 | 1 | 0 | 0 | 1 | 6′ | 25′ |
| 50 | 1 | 1 | 0 | 0 | 1 | 0 | 7′ | 25′ |
| 51 | 1 | 1 | 0 | 0 | 1 | 1 | 8′ | 25′ |
| 52 | 1 | 1 | 0 | 1 | 0 | 0 | 9′ | 25′ |
| 53 | 1 | 1 | 0 | 1 | 0 | 1 | 10′ | 25′ |
| 54 | 1 | 1 | 0 | 1 | 1 | 0 | 11′ | 25′ |
| 55 | 1 | 1 | 0 | 1 | 1 | 1 | 12′ | 25′ |
| 56 | 1 | 1 | 1 | 0 | 0 | 0 | 12′ | 26′ |
| 57 | 1 | 1 | 1 | 0 | 0 | 1 | 11′ | 26′ |
| 58 | 1 | 1 | 1 | 0 | 1 | 0 | 10′ | 26′ |
| 59 | 1 | 1 | 1 | 0 | 1 | 1 | 9′ | 26′ |
| 60 | 1 | 1 | 1 | 1 | 0 | 0 | | RESET |

TABLE 2

| No. | Hr.Ct. | Min. Ct. 16–48 | V. | Lo. | Hr. Hand |
|---|---|---|---|---|---|
| 0 | 0000 | | 1′ | 15′ | 12:00 |
| | | * | 2′ | 15′ | 12:30 |
| 1 | 0001 | | 3′ | 15′ | 1:00 |
| | | * | 4′ | 15′ | 1:30 |
| 2 | 0010 | | 4′ | 16′ | 2:00 |
| | | * | 3′ | 16′ | 2:30 |
| 3 | 0011 | | 2′ | 16′ | 3:00 |
| | | * | 1′ | 16′ | 3:30 |
| 4 | 0100 | | 1′ | 19′ | 4:00 |
| | | * | 2′ | 19′ | 4:30 |
| 5 | 0101 | | 3′ | 19′ | 5:00 |
| | | * | 4′ | 19′ | 5:30 |
| 6 | 0110 | | 4′ | 20′ | 6:00 |
| | | * | 3′ | 20′ | 6:30 |
| 7 | 0111 | | 2′ | 20′ | 7:00 |
| | | * | 1′ | 20′ | 7:30 |
| 8 | 1000 | | 1′ | 23′ | 8:00 |
| | | * | 2′ | 23′ | 8:30 |
| 9 | 1001 | | 3′ | 23′ | 9:00 |
| | | * | 4′ | 23′ | 9:30 |
| 10 | 1010 | | 4′ | 24′ | 10:00 |
| | | * | 3′ | 24′ | 10:30 |
| 11 | 1011 | | 2′ | 24′ | 11:00 |
| | | | 1′ | 24′ | 11:30 |
| 12 | 1100 | | RESET | | — |

*Represents the ½ HR. and $\overline{\frac{1}{2}\text{ HR.}}$ enable pulse from "OR" gate 103.

It is to be recognized, as hereinbefore mentioned, that the voltages applied to the display, i.e., V, $\frac{2}{3}$ V, $\frac{1}{3}$ V, and Lo, are provided, via transfer gates 141–156, and 208–227, by the electrical conductors A, B, X and XX such that the voltages can be applied to the hands in accordance with assignee's co-pending patent application Ser. No. 463,927.

Figure 7:
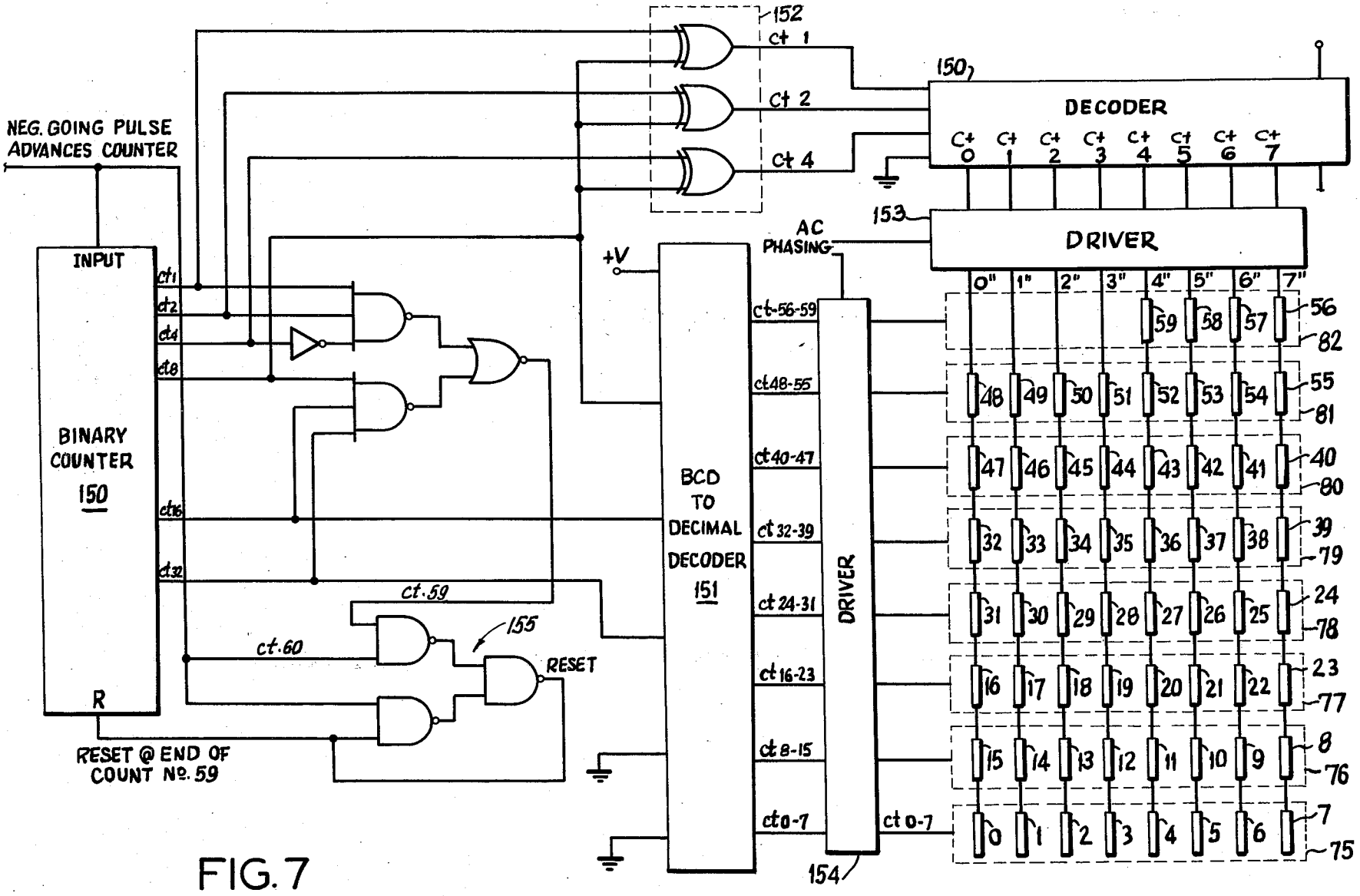
FIG. 7 is a simplified equivalent circuit of the decoder/driver logic and display.

Reference will now be made to FIG. 7 which shows a simplified equivalent circuit of the decoder/driver logic and display. It should be recognized, that the display shown herein not only serves to show, in a simplified way, the display matrix arrangement of the preferred embodiment, but may also serve to illustrate a possible alternative display arrangement in accordance with the present invention. At a counter output of zero, the Ct 1 and Ct 0–7 enable signals of the decoders 150, 151, respectively, are coupled to drivers 153, 154, respectively, causing activating voltages to be applied to string 0″ and transparent electrode 75 shown in phantom outline. With an activating voltage applied coincidentally to string 0″ and transparent electrode 75, hand 0 is actuated visually indicating the decoded count zero. The transparent electrode 75 is maintained in an activated state for the count of 0 through 7, during which decoder 150 up-counts sequentially and enables the strings 0″ through 7″ causing actuation of the time indicating hands consecutively from 0 through 7. At a count of eight, enable signal 7 is maintained by means of the exclusively "OR" circuit 152 and decoder 151 is advanced to the output enable signal ct 8–15 causing transparent electrode 76 to be activated. With an activating voltage applied to string 7″0 and coincidentally to electrode 76 hand 8 is actuated. Transparent electrode 76 is maintained in an activated state for a count of 8 through 15 during which decoder 150 in reverse sequential order enables strings 7″ through 0″, i.e. down-counts, causing actuation of hands 8 through 15. All the display hands are actuated by the decoder/driver logic in a similar manner until the counter 150 is reset. The counter 150 is reset at the end of a count 59 by the leading edge of the incoming 60th pulse by reset circuit 155. The up and down counting of the binary coded decimal-to-decimal decoder 150 and the coincident activation of the transparent electrodes 75–82 is clearly seen in tables 1 and 2 by the numbered electrical conductors coupled to the actuating potentials.

As mentioned hereinbefore the subject logic, dividing circuit and display are tailored to a type of horologic display in which the time of day is displayed by time indicating elements formed on an electrooptical display such as the liquid crystal type.

Thus, it should be recognized that any time indicating system in which a liquid crystal display, i.e., a display having a thin layer of liquid crystal material exhibiting dynamic scattering or field effect properties, having formed thereon time indicating elements which are interconnected in an alternating manner in circuit to form a pattern of strings of connected time indicating elements which form an addressable matrix with corresponding electrodes is intended to be within the scope of the following claims.

I claim:

1. A time indicating liquid crystal display for an electronic timepiece comprising:

a first substrate with a plurality of electrically conductive radial time indicating elements formed on a single surface of said first substrate and grouped into arcuate sets of adjacent circumferentially spaced time indicating elements, a second substrate with a plurality of common electrodes, each associated with one of said sets, liquid crystal electrooptic means between said first and second substrates, and conductor means formed on said single surface of said first liquid crystal substrate in an alternating manner for electrically connecting said radial time indicating elements into a plurality of strings, each string containing only one time indicating element from each set.

2. A time indicating liquid crystal display for an electric timepiece comprising: a first and a second substrate with liquid crystal electrooptic means in between, said first substrate having a plurality of radial electrically conductive hands formed on a single surface of said first liquid crystal substrate, said hands being divided into arcuate sets and each set having a plurality of circumferentially spaced hands, said hands being interconnected on said single surface of said first substrate in an alternating manner between the inside and outside of the sets to form a plurality of strings of hands, each string of hands having no more than one hand in a set, said second substrate having a plurality of arcuate electrodes each associated with a set of hands, said display being adapted to be actuated by the application of a potential across an electrode associated with a set and a hand in that set;

first electrical connections each associated with a string of hands; and second electrical connections each associated with an electrode.

3. A timepiece as in claim 2 wherein:

said display has formed thereon sixty radial hands on an outer circle for indicating minutes and twelve radial hands on an inner circle for indicating hours.

4. A time indicating liquid crystal display for an electronic watch comprising: a first and a second substrate with liquid crystal electrooptic means in between, said first substrate having on a single surface sixty electrically conductive hands formed on an outer circle and at least twelve hands formed on an inner circle, said hands on each circle being divided into groups with each group having a plurality of hands, said hands in each group being interconnected on said single surface in an alternating manner to form a plurality of strings of hands connected in series circuit with each string having no more than one hand in a group, said second substrate having a plurality of electrodes each associated with a group of hands, said display being adapted to be actuated by the application of a potential across a hand in a group and the electrode associated with that group of hands;

first electrical connections each associated with one string of hands; and second electrical connections each associated with one electrode.

5. An electronic watch as in claim 4 wherein the sixty hands on said outer circle indicate minutes and seconds.

6. An electronic watch as in claim 4 wherein there are twenty-four of said hands on the inner circle to indicate hours and half hours.

7. An electronic watch as in claim 4 wherein the sixty hands on said outer circle indicate minutes and seconds and there are twenty-four hands on the inner circle to indicate hours and half hours.

8. A time indicating liquid crystal display for an electronic watch comprising a first and a second substrate with liquid crystal electrooptic means in between, said first substrate having on a single surface no more than sixty electrically conductive hands formed on an outer circle and at least twelve hands formed on an inner circle, said hands formed on said outer and said inner circles being divided into groups sequentially around the watch display with each group containing a plurality of hands, said hands being connected in an alternating manner on said single surface to form at least one string containing no more than one hand in a group and, said string having a hand in a first group connected to a hand in an adjoining group which occupies a sequentially reversed position with respect to the position of the hand in said first group, said second substrate having a plurality of electrodes each associated with one group of hands, whereby a hand is actuated to visibility by the application of a potential across a hand in a group and the electrode associated with that group of hands.

* * * * *